US005467577A

United States Patent [19]

Sato

[11] Patent Number: 5,467,577

[45] Date of Patent: Nov. 21, 1995

[54] APPARATUS AND METHOD OF ENCLOSING AND SEALING ENCLOSURE

[75] Inventor: Koki Sato, Tokyo, Japan

[73] Assignee: Juki Corporation, Chofu, Japan

[21] Appl. No.: 145,344

[22] Filed: Oct. 29, 1993

[30] Foreign Application Priority Data

Nov. 6, 1992 [JP] Japan ..... 4-296783

[51] Int. Cl.[6] ..... B43M 3/00; B65B 5/00; B65B 57/14

[52] U.S. Cl. ..... 53/468; 53/284.3; 53/473; 53/493; 53/569

[58] Field of Search ..... 53/284.3, 493, 53/55, 460, 58, 569, 468, 467, 473, 381.6, 381.7, 381.5, 504, 564

[56] References Cited

U.S. PATENT DOCUMENTS

| | | | |
|---|---|---|---|
| 4,077,181 | 3/1978 | Asher et al. | 53/78 |
| 4,649,691 | 3/1987 | Buckholz | 53/53 |
| 4,739,606 | 4/1988 | Cantile | 53/493 |
| 4,798,040 | 1/1989 | Haas et al. | 53/493 X |
| 5,125,214 | 6/1992 | Orsinger et al. | 53/284.3 X |
| 5,327,701 | 7/1994 | Dronsfield | 53/284.3 |

OTHER PUBLICATIONS

International Application Published Under the Patent Cooperation Treaty, International Publication No. WO 91/11336, corresponding to International Application No. PCT/GB91/00105, International Filing Date Jan. 24, 1991.

*Primary Examiner*—James F. Coan
*Attorney, Agent, or Firm*—Fitch, Even, Tabin & Flannery

[57] ABSTRACT

An insert carriage having a manipulating member attached thereto for inserting an enclosure into an envelope is arranged reciprocally in the direction of said envelope. By moving said insert carriage, said manipulating member may be reciprocated between the basic position and the position of the fold line of said envelope which is the inserting position. A carriage motor for driving said insert carriage is provided. A control unit is provided, said control unit comprising a variable amount inputting section adapted to input the variable amount is respect to the inserting position of the manipulating member in conformity with the thickness or quality of paper of said envelope, a memory section adapted to store said variable amount and a CPU section adapted to controllably drive said carriage motor in accordance with the variable amount store in said memory section to adjust the inserting position of said manipulating member.

9 Claims, 7 Drawing Sheets

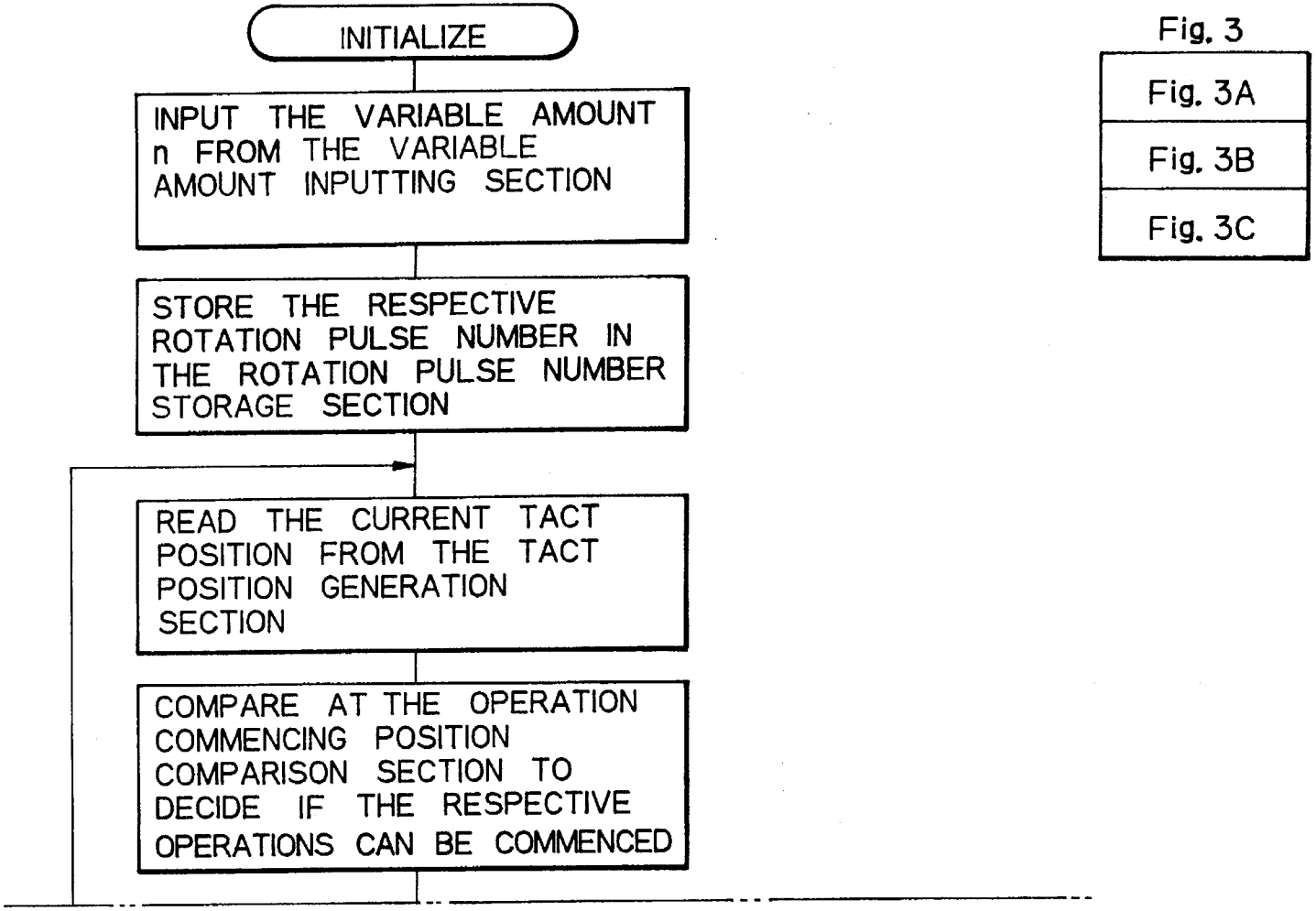
Fig. 3
Fig. 3A
Fig. 3B
Fig. 3C
Fig. 3A
INITIALIZE
INPUT THE VARIABLE AMOUNT n FROM THE VARIABLE AMOUNT INPUTTING SECTION
STORE THE RESPECTIVE ROTATION PULSE NUMBER IN THE ROTATION PULSE NUMBER STORAGE SECTION
READ THE CURRENT TACT POSITION FROM THE TACT POSITION GENERATION SECTION
COMPARE AT THE OPERATION COMMENCING POSITION COMPARISON SECTION TO DECIDE IF THE RESPECTIVE OPERATIONS CAN BE COMMENCED

APPARATUS AND METHOD OF ENCLOSING AND SEALING ENCLOSURE

BACKGROUND OF THE INVENTION

The present invention relates to an enclosing and sealing apparatus, or more particularly to an enclosing and sealing apparatus adapted to automatically pick up enclosures such as brochures for the purpose of direct mail or the like one by one and/or several pieces thereof at one time and enclose them in envelopes and seal the same.

DESCRIPTION OF PRIOR ART

A number of enclosing and sealing apparatuses have been used for automatically inserting enclosures such as brochures for direct mail or the like into envelopes and sealing the same.

According to such a conventional enclosing and sealing apparatus as above described, specified enclosures are supplied on the upper surface of a base. At one side of the base, the mouth portion of a specified envelope is placed toward an enclosure and the fold line of the flap formed continuously along one edge of the mouth portion of said envelope is placed adjacent the side edge of said base.

At the underside of said base, there is reciprocatably disposed an insert carriage having a manipulating member adapted to abut against the enclosure attached at the tip end thereof. Movement of said insert carriage causes the manipulating member to be reciprocated between the basic position and the position of the fold line of said envelope which is the inserting position.

According to the enclosing and sealing apparatus of the prior art as above explained, an enclosure is supplied on the upper surface of said base, an envelope is placed at the side of the base and the upper surface of the envelope is sucked by an opening pad to open the mouth of the envelope. Then, said insert carriage is moved to shift the manipulating member then located at the basic position to the inserting position whereby said enclosure is moved by the manipulating member toward the envelope. Then the enclosure is inserted into the envelope in such a manner that the rear end portion is located at the fold line of said envelope.

Subsequently, the insert carriage is returned to feed the next enclosure to the base. By repeating the above-mentioned operation, the enclosures are inserted successively into envelopes. Then the envelopes with the enclosures enclosed therein are sealed by folding the flap along the fold line and adhering the flap to the envelopes.

According to the enclosing and sealing apparatus of the prior art as explained above, however, since the distance that the enclosure is pushed by the manipulating member to the fold line of the flap of an envelope is fixed, the enclosure cannot be properly inserted into the interior of the envelope and, as a consequence, the subsequent sealing work cannot be properly executed if the thickness of enclosures varies.

For example, if a thin or soft enclosure is used, the enclosure cannot be inserted properly into an envelope in response to the pushing action exerted by the manipulating member due to the resistance of the envelope at the time of insertion, and since the enclosure may be flexed, when the manipulating member is retracted, the flection may be released and the rear end portion of the enclosure may project outwardly of the fold line of the flap of the envelope. On the other hand, if a thick or hard enclosure is used, it will not cause flection like in the case of a thin enclosure but the envelope may be deformed upon insertion of such an enclosure, displacing the folding position of the flap. Furthermore in the case of a thick enclosure, if the rear end portion of such an enclosure comes adjacent to the folding position of the flap, it makes sealing work difficult and a poor sealing work may likely result.

SUMMARY OF THE INVENTION

Accordingly, the present invention has been proposed In light off all these problems and an object of the present invention is to provide an enclosing and sealing apparatus capable of adjusting the inserting position of the manipulating member easily and properly in relation to the thickness or quality of paper of the enclosure in question and enabling the enclosure to be positively inserted into an envelope by the manipulating member.

In order to attain the object as above mentioned, the enclosing and sealing apparatus according to the present invention is so constructed that an enclosing and sealing apparatus comprising a base having upper surface onto which a specified enclosure is supplied, an envelope being disposed with a flap at an envelope side of the base, the foldable flap being opened at a mouth portion of the envelope, and an insert carriage having a manipulating member for abutment with the enclosure on the base and disposed reciprocatable toward and away from the envelope, and adapted to reciprocatably move the manipulating member between a basic position and an insert position corresponding to said mouth portion by reciprocating said insert carriage, said enclosing and sealing apparatus further comprising: a carriage motor for reciprocatably driving said insert carriage; an input section for inputting a set point for designating the insert position of said manipulating member corresponding to the thickness or quality of paper of said enclosure; a memory section for storing said set point; and a control unit for driving and controlling said carriage motor so as to bring the insertion position of said manipulating member to the predetermined position in response to the set point of said memory unit.

According to the enclosing and sealing apparatus of the present invention, the control unit inputs the variable amount in respect to the inserting position of the manipulating member from the variable amount inputting section and stores the same in the memory section and causes tile CPU section to automatically adjust the inserting position of the manipulating member in relation to the fold line of the envelope in accordance with the variable amount stored in the memory section, and, in case of a thin or a soft enclosure being inserted, the inserting position of the manipulating member can be automatically located inwardly of the folding line of the flap of the envelope in consideration of flection of the enclosure and in case of a thick or a hard enclosure being inserted, the inserting position of the manipulating member may be automatically located more closely to the envelope than the folding line of the flap in consideration of deformation of the envelope which may be caused upon insertion of the enclosure, through a simple operation of inputting the specified variable amount, whereby the enclosure can be inserted into the envelope at a proper position relative to the folding line of the flap.

BRIEF EXPLANATION OF THE DRAWINGS

Embodiments of the present invention will now be explained with reference to the accompanying drawings in which;

FIG. 2 is illustrated with FIGS. 2A and 2B;

FIG. 8 is the flow diagram illustrating the control operation conducted by the control unit according to the present invention.

DESCRIPTION OF THE PREFERRED EMBODIMENTS

Figure 1:
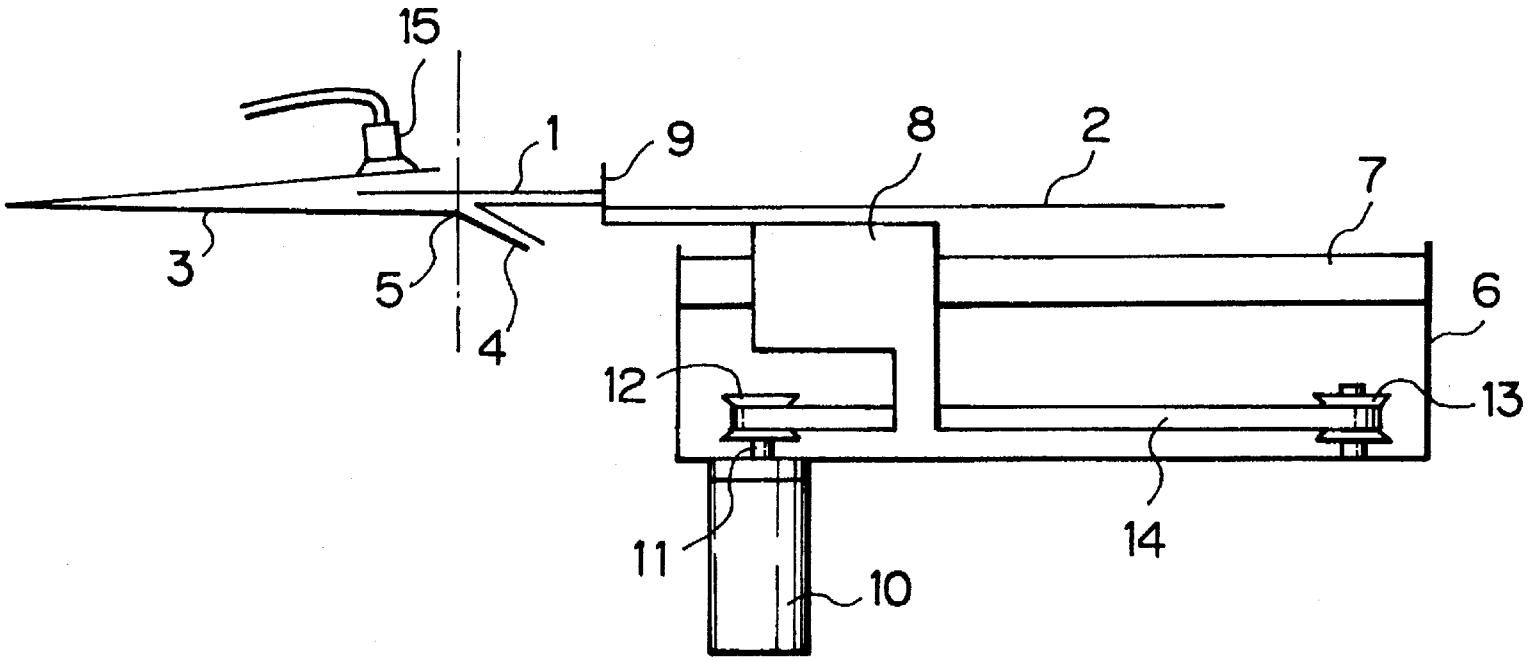
FIG. 1 is a schematic constitutional drawing illustrating an embodiment of the enclosing and sealing apparatus according to the present invention.

FIG. 1 illustrates an embodiment of the enclosing and sealing apparatus according to the present invention, wherein specified envelopes 3 are transferred to one side of the base 2 to which specified enclosures 1 are to be supplied, the flap 4 formed continuously along one end edge of the envelope 3 is placed at the underside of the base 2 and the fold line 5 of said flap 4 is disposed adjacent to the side edge of said base 2.

Below the underside of said base 2, there is arranged a carriage case 6. Inside of the carriage case 6, there is disposed a carriage shaft 7 extending in the direction of said envelope 3. An insert carriage 8 is reciprocally mounted along the carriage shaft 7 and the upper tip end portion of the insert carriage 8 is attached with the manipulating member 9 having the tip end serving as the pressing surface. A part of the manipulating member 9 projects from the upper surface of the base 2 through the slit not shown formed in said base 2.

The output shaft 11 of the carriage motor 10 is provided at the underside of one end portion of the carriage case 6 in such a manner as to project inwardly of said carriage case 6 and a drive pulley 12 is attached to the output shaft 11 of the carriage motor 10. At the other end of the carriage case 6, there is provided a driven pulley 13. Between the drive pulley 12 and the driven pulley 13, a belt 14 with the insert carriage 8 coupled thereto is tensioned. By driving the belt 14 via the drive pulley 12 and the driven pulley 13 by driving said carriage motor 10, the insert carriage 8 will be reciprocally moved along the carriage shaft 7 and the enclosure 1 fed onto the upper surface of the base 2 by means of the manipulating member will be moved to the side of said envelope 3.

An opening pad 15 is provided above the envelope 3 in a manner to be liftable so as to suck the upper surface of the envelope 3 to open the mouth of the envelope 3.

Figure 2A:
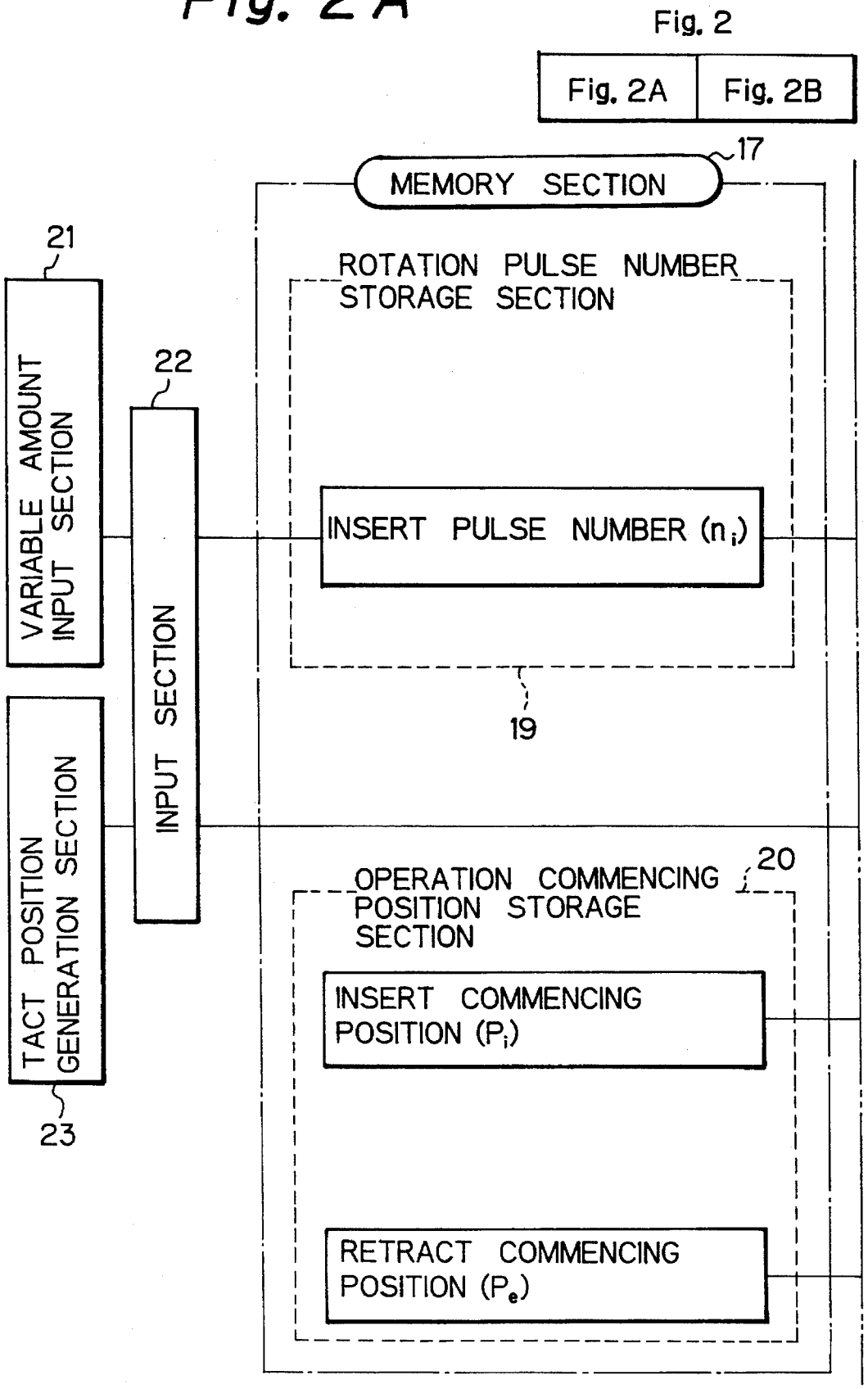
FIG. 2 is a block diagram illustrating an embodiment of the control unit for controlling the enclosing and sealing apparatus according to the present invention.
Figure 2B:
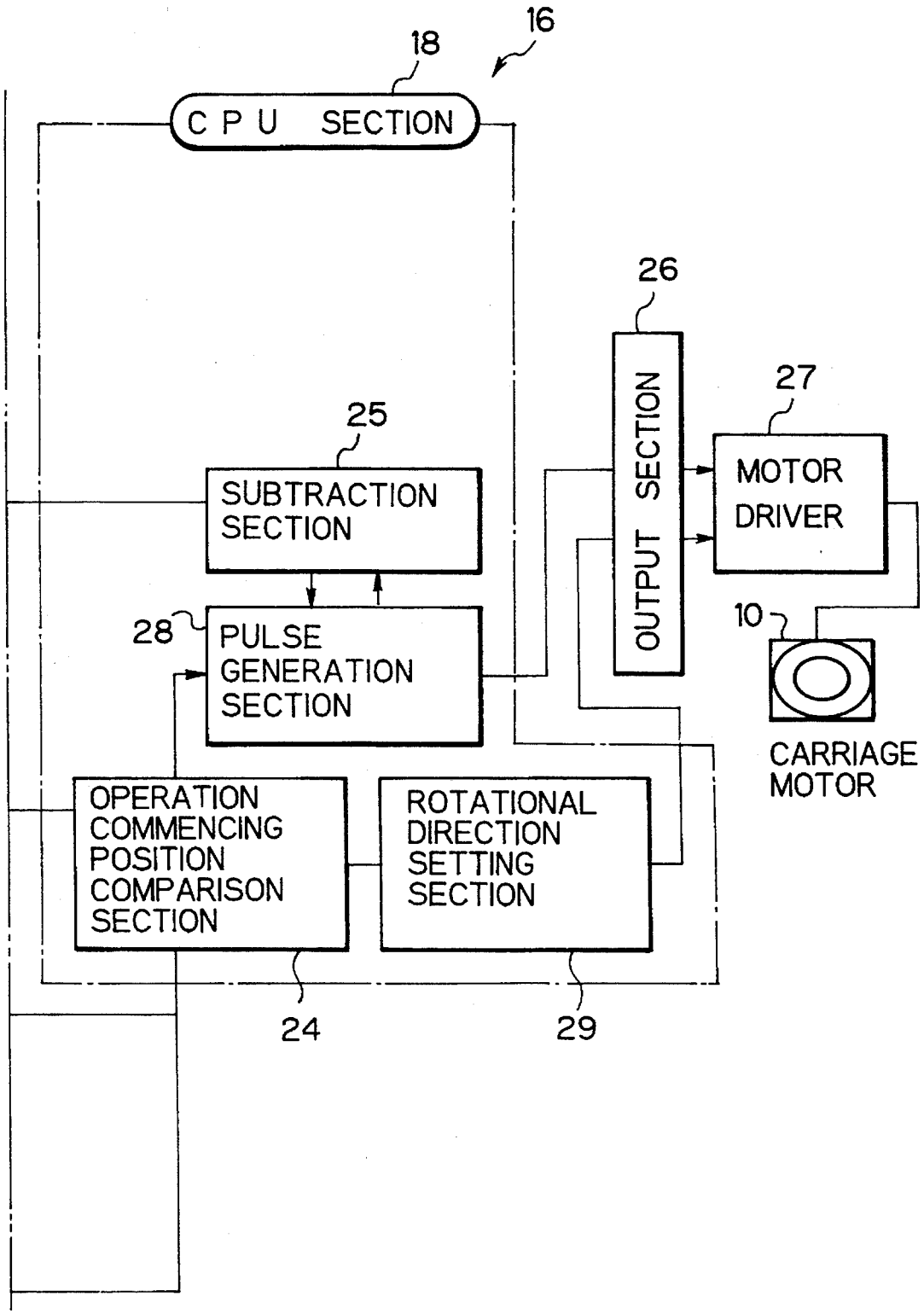

FIG. 2 illustrates an embodiment of the control unit for controlling the enclosing and sealing apparatus according to the present invention. This control unit 16 includes a memory section 17 for storing specified informations and a CPU section 18 for conducting required control in accordance with the informations stored in the memory section 17. The memory section 17 of said control unit 16 contains a rotation pulse number storage section 19 and an operation commencing position storage section 20. The rotation pulse number storage section 19 is adapted to store the number $n_i$ of the insert pulse necessary for conducting insert operation so as to cause the carriage motor 10 to be activated for driving the insert carriage 8 from the basic position to the inserting position. The rotation pulse number storage section 19 is input with specified variable amounts through the input section 22 from the variable amount inputting section 21 provided for example at an operational panel or the like. For instance, if the variable amount n is input from the variable amount inputting section 21, and if the initial value of the insert pulse number is assumed to be $N_i$ (the pulse number in the case of the tip end of the manipulating member 9 being moved to the folding position 5 of the flap 4 of the envelope 3) the insert pulse number $n_i$ will be $n_i=N_i+n$.

The operation commencing position storage section 20 is adapted to store respectively the tact position $P_i$ for commencing insert operation and the tact position $P_e$ for commencing retract operation from the inserting position to the basic position. The tact positions for commencing these operations respectively are those positions for commencing the respective operations in accordance with the timing relative to the operations of the other members constituting the enclosing and sealing apparatus.

In said CPU section 18, there is arranged an operation commencing position comparison section 24 in which the current tact position $a_P$ of the enclosing and sealing apparatus is input from the tact position generation section 23 and the respective operation commencing positions stored in said operation commencing position storage section 20 are input. The operation commencing position comparison section 24 compares the current tact position of the enclosing and sealing apparatus sent from the tact position generation section 23 with the operation commencing positions respectively of the insert and retract operations sent from the operation commencing position storage section 20 and when the current tact position conforms to the respective operation commencing positions, an operation commencement enable signal is output.

Further in said CPU section 18, there is arranged a subtraction section 25 adapted to set in the incorporated counter not shown the number of insert pulses read from the rotation pulse number storage section 19. A pulse generation section 28 is connected to the subtraction section 25, the pulse generation section 28 being adapted to transmit a drive pulse to the motor driver 27 which controllably drives the carriage motor 10 via the output section 26 by the signals corresponding to one pulse sent from the counter of the subtraction section 25 in accordance with the operation commencement enable signal sent from said operation commencing position comparison section 24 and outputs a signal for causing the counter of the subtraction section to subtract each one pulse.

Furthermore, a rotational direction setting section 29 is connected to the operation commencing position comparison section 24, said rotational direction setting section being adapted to cause said motor driver 27 to set the rotational direction of the carriage motor in accordance with the operation commencement enable signal provided by said operation commencing position comparison section 24.

Figure 3B:
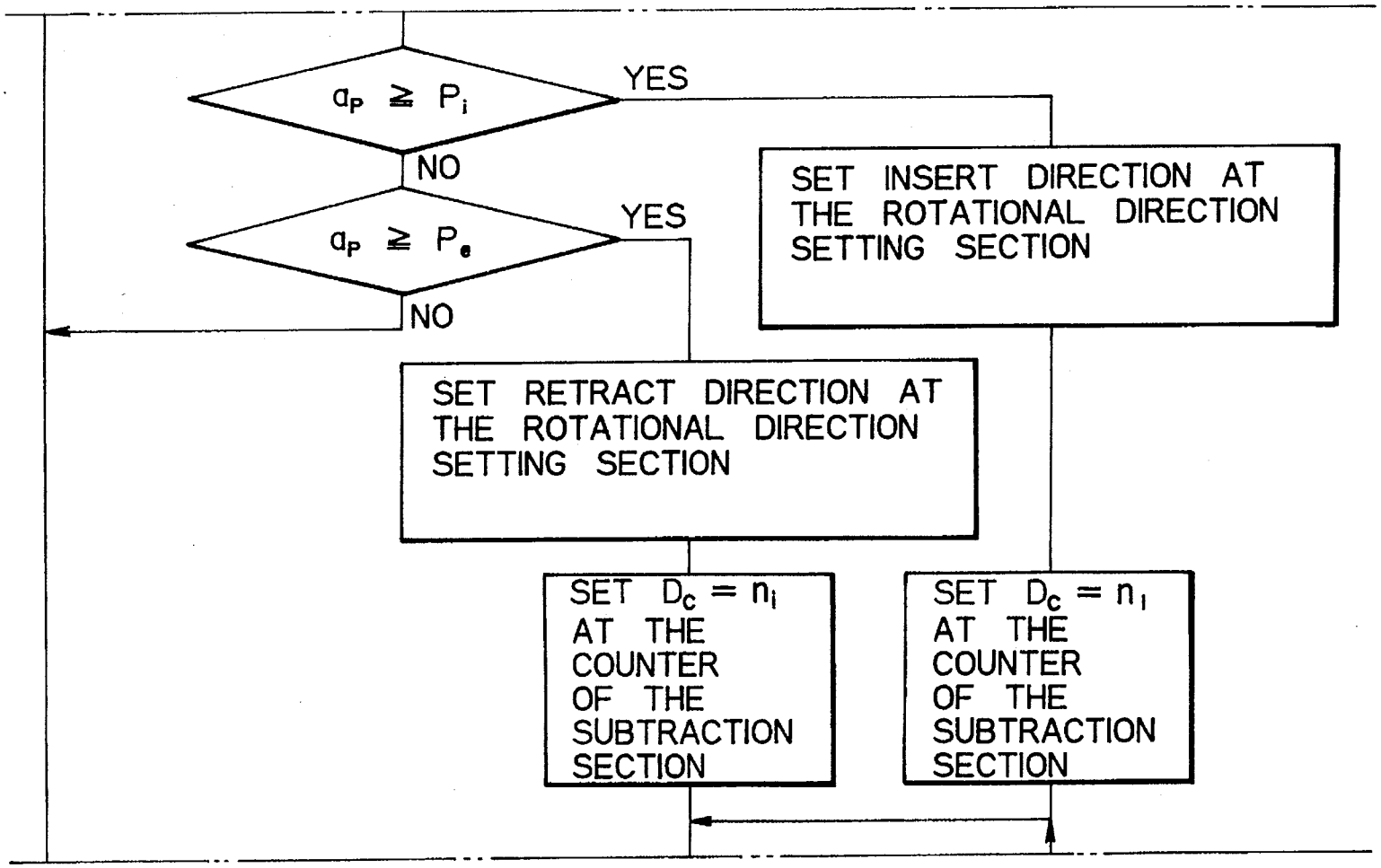
FIG. 3 is illustrated with FIGS. 3A, 3B and 3C.
Figure 3C:
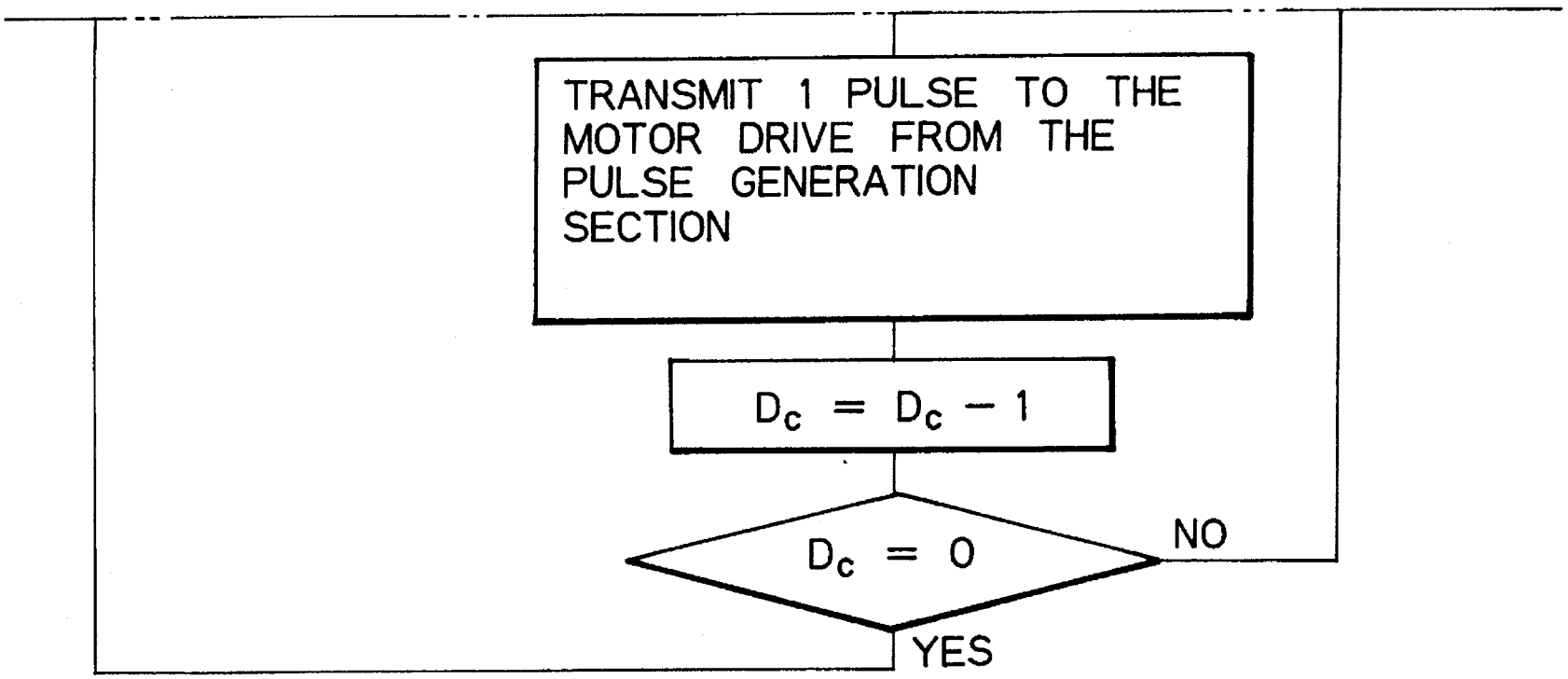

The function of the present embodiment will now be explained by referring to the flow diagram in FIG. 3.

First of all, depending on the thickness or quality of paper of the enclosures 1, the variable amount n in respect of the inserting position of the insert carriage 8 is input from the variable amount inputting section 21 whereby the insert pulse number $n_i=N_i+n$ based on the variable amount n is stored in the rotation pulse number storage section 19. In this instant, if a thick enclosure 1 or a thin enclosure 1 is to be inserted, the variable amount n may be set to the side (+) so that the inserting position of the manipulating member 9 may be located inwardly of the position of the fold line 5 of the envelope's flap 4.

Nextly, the current tact position $a_p$ of the enclosing and sealing apparatus from the tact position generation section 23 is read by the operation commencing position comparison section 24 and the operation commencing positions $P_i$, $P_e$ respectively of the insert and retract operations sent from the operation commencing position storage section 20 are read, such that the current tact position $a_p$ and the respective operation commencing positions are compared to decide if the respective operations can be commenced.

If $a_p \geqq P_i$, an operation commencement enable signal is output to the rotation pulse generation section 28 from the operation commencing position comparison section 24 and also an operation commencement enable signal is output to the rotational direction setting section 29 which, in turn, outputs to the motor driver 27 a signal to set the rotational direction of the carriage motor 10.

In the meantime, the subtraction section 25 reads the insert pulse number $n_i$ from the rotation pulse storage section 19 and sets the counter D therein at $D_c=n_i$. If said operation commencement signal is input to the pulse generation section 28, a signal corresponding to 1 pulse is sent from the subtraction section 25 to the pulse generation section 28 which, in turn, outputs a pulse signal for each 1 pulse to the motor driver 27 and outputs to the subtraction section a signal for subtraction for each 1 pulse. By doing this, said motor driver 27 causes the carriage motor 10 to be driven by the amount corresponding to 1 pulse in the rotational direction output by said rotational direction setting section 29. The pulse number in the counter is subtracted by the subtraction section 25 to $D_c=D_c-1$. Signals are again output to the pulse generation section 28. The above-described operations are repeated. When the counter of the subtraction section 25 comes to $D_c=0$ the operations are terminated. In this way, the inserting positions may be set by the insert pulse number. Furthermore, the operation commencing position comparison section 24 read the current tact position. If $_p \geqq P_e$, the basic position will be set by the retract operation like in the case of the above operations and the operational position of the manipulating member or the insert carriage 8 will be completely set by a specified variable amount n through the respective operations.

Figure 4:
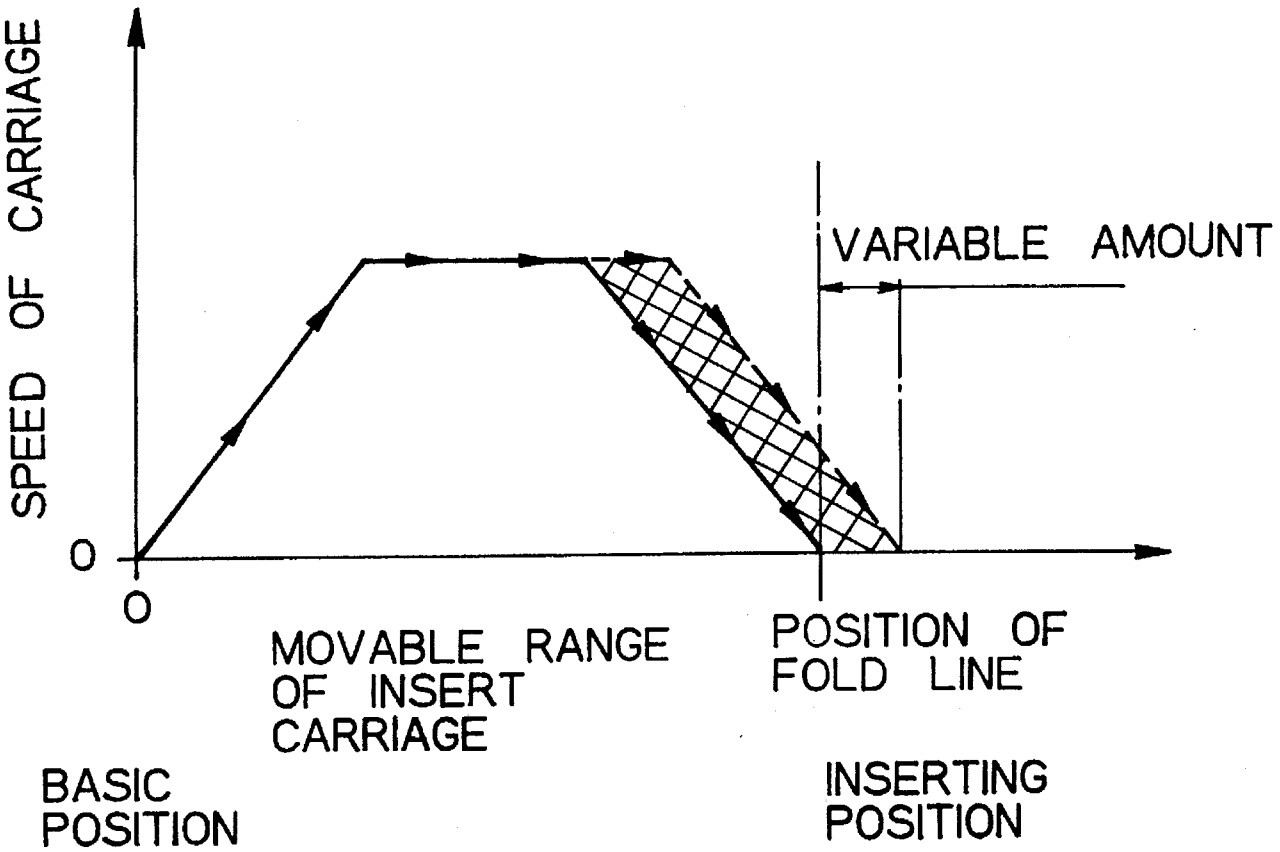
FIG. 4 is the diagram illustrating the manner of the carriage motor being driven under control by the present invention.

As described above the variable amount has been inputted, an enclosure 1 is supplied to the upper surface of said base 2, an envelope 3 is disposed by the side of the base 2 and the opening pad 15 is activated to suck the upper surface of the envelope 3 to open the envelope 3 thereby. Then the carriage motor 10 is driven to move the insert carriage 8 along the carriage shaft 7 by way of the drive pulley 12 and the belt 14 respectively, whereby the manipulating member 9 then located at the basic position will be moved to the inserting position. In this case, if the variable amount has been set to the side of (+), the carriage motor 10 is driven according to the drive pulse number which has been so set that the constant speed range may be extended as shown in FIG. 4. In this way, the enclosure 1 is moved toward the envelope 3 by the manipulating member so that the envelope 1 will be inserted into the envelope 3.

According to the present embodiment, if a thin or a soft enclosure 1 is to be inserted, since the inserting position of the manipulating member 9 may be automatically located inwardly of the position of the fold line 5 of the envelope's flap 4 by setting the variable amount n to the side of (+) in consideration of possible flection of the enclosure 1, this enclosure 1 may be further inserted into the envelope 3 than normal enclosures whereby, even if the enclosure 1 may be flexed upon insertion by the resistance of the envelope 3, the tip end of the enclosure 1 may not project out of the fold line 5 of the envelope's flap 4 in case that the flection will be restored by retraction of the manipulating member 9. On the other hand, if a thick or a hard enclosure 1 is to be inserted, since the inserting position of the manipulating member 9 may be automatically displaced to the envelope side than the position of the fold line 5 of the flap 4 of the envelope 3 in consideration of possible deformation of the envelope 3 caused by insertion of the enclosure 1, the enclosure 1 can be inserted at the proper position relative to the position of the fold line 5 of the flap 4 in case that the position of the fold line 5 of the flap 4 may be displaced due to deformation of the envelope 3.

Subsequently, by rotating the carriage motor 10 in the reversed direction, the insert carriage 8 may be returned to the basic position to supply the next enclosure 1 to the base 2. Thus by repeating the abovedescribed operations, the enclosures 1 are successively inserted into the envelopes.

According to the present embodiment, therefore, since the inserting position of the manipulating member 9 may be automatically adjusted through a simple operation of inputting a particular variable amount, the inserting position of the manipulating member 9 may be properly adjusted in conformity with the thickness of the enclosures in question, whereby the adjustment work efficiency can be significantly enhanced and enclosures 1 can be properly inserted into envelopes.

While the embodiment describes the case of one enclosure, several enclosures may be enclosed and sealed at a time by the same way.

It is to be understood that the present invention should not be limited to the illustrated embodiment but various changes and modifications may be executed as required.

As explained above, according to the enclosing and sealing apparatus of the present invention, since the position of the manipulating member may be automatically adjusted to a proper inserting position in conformity with the thickness or quality of paper of the enclosures in question through a simple operation of inputting a specified variable amount from the variable amount inputting section of the control unit, an accurate inserting operation in conformity with the thickness of enclosures may be attained as the consequence and subsequently a proper sealing operation may be attained for enclosures.

What is claimed is:

1. A method of enclosing and sealing comprising the steps of;

arranging an insert carriage in a manner to be reciprocatable in the direction of an envelope, said insert carriage having a manipulating member for abutting an enclosure against an enclosure attached to a base having the upper surface onto which a specified enclosure is supplied, the envelope being disposed with a foldable flap connected to the mouth portion of the envelope via a fold line being located to the side of said enclosure at one side of the base;

reciprocally moving said manipulating member between a basic position and an insert position corresponding to said fold line of the envelope by moving said insert carriage;

providing a carriage motor for driving said insert carriage;

inputting variable amounts for indicating the desired insert positions of said manipulating member in conformity with the thickness or quality of paper of the enclosure;

storing an insert pulse number based on said variable amounts;

detecting the starting timing respectively of an insert operation and a return operation in accordance with the rotary angle of the carriage motor; and rotationally controlling said carriage motor toward said envelope by the amount corresponding to said insert pulse number when said detecting step has detected that the insert operation can be started and away from said envelope by the amount corresponding to a return pulse number when said detecting step has detected that the return operation can be started.

2. A method of enclosing and sealing as defined in claim 1 further comprising the step of sucking the upper surface of the envelope to open the mouth of the envelope wherein said inputting step is for locating the insertion position of said manipulating member inwardly of the position of the fold line of the envelope flap.

3. An enclosing and sealing apparatus comprising a base having an upper surface onto which a specified enclosure is supplied, a specified envelope being disposed with a foldable flap connected to the mouth portion of the envelope via a fold line being located to the side of said enclosure, and an insert carriage with a manipulating member for abutting against the enclosure being arranged on the base in a manner to be reciprocatable toward the envelope, and adapted to reciprocatably move the manipulating member between a basic position and an insert position by moving the insert carriage, said enclosing and sealing apparatus further comprising:

a carriage motor for driving said insert carriage;

a variable amount inputting section for inputting variable amounts for designating the desired insert positions of said manipulating member in conformity with the thickness or quality of paper of the enclosure;

a memory section for storing an insert pulse number based on the variable amounts;

an operation starting position comparison section for detecting the starting timing respectively of an insert operation and a return operation in accordance with the rotary angle of the carriage motor; and a control unit for rotating said carriage motor in the direction of said envelope by said insert pulse number when said operation starting position comparison section detects the possibility of starting of the insert operation and for rotating said carriage motor in the opposite direction of said envelope by a return pulse number when said operation starting position comparison section detects the possibility of starting of the return operation.

4. An enclosing and sealing apparatus as defined in claim 3, wherein said operation starting position comparison section compares an insert operation commencing position stored in advance and an envelope movement commencing position stored in advance with a current tact position based on the rotary angle of the carriage motor to determine the respective operation commencing positions.

5. An enclosing and sealing apparatus as defined in claim 3 wherein said apparatus further comprises an opening pad for sucking the upper surface of the envelope to open the mouth portion of the envelope and wherein said variable amount inputting section locates the insert position of said manipulating member inwardly of the position of the fold line of the envelope flap in conformity with the thickness or quality of paper of the enclosure.

6. An enclosing and sealing apparatus as defined in claim 3, wherein said variable amount is assumed to be n, and said insert pulse number and retract pulse number are $N_i$+n (provided $N_i$ is the initial value of the insert pulse).

7. An enclosing and sealing apparatus as defined in claim 4, wherein said variable amount is assumed to be n, and said insert pulse number and retract pulse number are $N_i$+n (provided $N_i$ is the initial value of the insert pulse).

8. An enclosing and sealing apparatus comprising a base having an upper surface onto which a specified enclosure is supplied, an envelope being disposed with a foldable flap at an envelope side of the base, the foldable flap being opened at a mouth portion of the envelope via a fold line located to the side of said enclosure, and an insert carriage having a manipulating member for abutment with the enclosure on the base and disposed reciprocatable toward and away from the envelope and adapted to reciprocatably move the manipulating member between a basic position and an insert position corresponding to said mouth portion by reciprocating said insert carriage, said enclosing and sealing apparatus further comprising:

a carriage motor for reciprocatably driving said insert carriage;

an input section for inputting a set value to designate the insert position of said manipulating member corresponding to the thickness or quality of paper of said enclosure;

a memory for storing said set value; and a control unit for driving and controlling said carriage motor so as to bring the insert position of said manipulating member to a predetermined position in response to the set value of said memory.

9. An enclosing and sealing apparatus as defined in claim 8 wherein said apparatus further comprises an opening pad for sucking the upper surface of the envelope to open the mouth portion of the envelope and wherein said control unit drives and controls said carriage motor so as to locate the insert position of said manipulating member inwardly of the position of the fold line of the envelope flap, in response to the set value of said memory.

* * * * *